US006747535B2

(12) United States Patent
Castonguay et al.

(10) Patent No.: US 6,747,535 B2
(45) Date of Patent: Jun. 8, 2004

(54) PRECISION LOCATION SYSTEM BETWEEN ACTUATOR ACCESSORY AND MECHANISM

(75) Inventors: Roger Castonguay, Terryville, CT (US); Dean A. Robarge, Southington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/065,702

(22) Filed: Nov. 12, 2002

(65) Prior Publication Data

US 2003/0071702 A1 Apr. 17, 2003

Related U.S. Application Data

(63) Continuation of application No. 09/536,360, filed on Mar. 27, 2000, now abandoned.

(51) Int. Cl.[7] ..... H01H 67/02

(52) U.S. Cl. ..... 335/132; 200/330; 335/185

(58) Field of Search ..... 200/258–308, 200/330, 332, 400, 401, 331; 335/8–10, 16, 185–201, 167–178, 132, 147, 195; 218/22

(56) References Cited

U.S. PATENT DOCUMENTS

| | | | | |
|---|---|---|---|---|
| 1,999,410 A | * | 4/1935 | Graves, Jr. et al. | 200/89 |
| 2,340,682 A | | 2/1944 | Powell | |
| 2,719,203 A | | 9/1955 | Gelzheiser et al. | |
| 2,937,254 A | | 5/1960 | Ericson | |
| 3,098,910 A | * | 7/1963 | Schwartz | 200/106 |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 3,958,095 A | | 5/1976 | Zaffrann et al. | 200/48 R |
| 4,129,762 A | | 12/1978 | Bruchet | |
| 4,144,513 A | | 3/1979 | Shafer et al. | |
| 4,158,119 A | | 6/1979 | Krakik | |

(List continued on next page.)

FOREIGN PATENT DOCUMENTS

| | | |
|---|---|---|
| BE | 819 008 A | 12/1974 |
| BE | 897 691 A | 1/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |

(List continued on next page.)

*Primary Examiner*—James R. Scott
(74) *Attorney, Agent, or Firm*—Cantor Colburn LLP

(57) ABSTRACT

A precision location system for a circuit breaker utilizing a phase cassette concept is disclosed. A cover plate is mounted to at least one of a plurality of single-pole units having a circuit breaker operating mechanism positioned thereon. The cover plate is configured to precisely align an actuator precisely located on the cover with the circuit breaker operating mechanism. The actuator trips a latch of the operating mechanism, thereby tripping the entire circuit.

23 Claims, 3 Drawing Sheets

U.S. PATENT DOCUMENTS

| | | | | |
|---|---|---|---|---|
| 4,165,453 | A | | 8/1979 | Hennemann |
| 4,166,988 | A | | 9/1979 | Ciarcia et al. |
| 4,220,934 | A | | 9/1980 | Wafer et al. |
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,157,366 | A | * | 10/1992 | Mullins et al. ..... 335/8 |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | * | 1/1994 | Morel et al. ..... 200/144 R |
| 5,296,660 | A | | 3/1994 | Morel et al. |
| 5,296,664 | A | | 3/1994 | Crookston et al. |
| 5,298,874 | A | * | 3/1994 | Morel et al. ..... 335/8 |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,504,284 | A | | 4/1996 | Lazareth et al. |

| | | | | |
|---|---|---|---|---|
| 5,504,290 | A | 4/1996 | Baginski et al. | |
| 5,510,761 | A | 4/1996 | Boder et al. | |
| 5,512,720 | A | 4/1996 | Coudert et al. | |
| 5,515,018 | A | 5/1996 | DiMarco et al. | |
| 5,519,561 | A | 5/1996 | Mrenna et al. | |
| 5,534,674 | A | 7/1996 | Steffens | |
| 5,534,832 | A | 7/1996 | Duchemin et al. | |
| 5,534,835 | A | 7/1996 | McColloch et al. | |
| 5,534,840 | A | 7/1996 | Cuingnet | |
| 5,539,168 | A | 7/1996 | Linzenich | |
| 5,543,595 | A | 8/1996 | Mader et al. | |
| 5,552,755 | A | 9/1996 | Fello et al. | |
| 5,581,219 | A | * 12/1996 | Nozawa et al. | 335/132 |
| 5,604,656 | A | 2/1997 | Derrick et al. | |
| 5,608,367 | A | 3/1997 | Zoller et al. | |
| 5,784,233 | A | 7/1998 | Bastard et al. | |
| 6,049,051 | A | 4/2000 | Dosmo et al. | 218/155 |

FOREIGN PATENT DOCUMENTS

| | | |
|---|---|---|
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| SU | 1 227 978 | 1/1984 |
| WO | 92/00598 | 1/1992 |
| WO | 92/05649 | 4/1992 |
| WO | 94/00901 | 4/1992 |

* cited by examiner 10
12
14
16
17
18
19
20
21
22
24
26
28
29
30
32
34
36

PRECISION LOCATION SYSTEM BETWEEN ACTUATOR ACCESSORY AND MECHANISM

CROSS REFERENCE TO RELATED APPLICATIONS

This application is a continuation of U.S. patent application Ser. No. 09/536,360 filed on Mar. 27, 2000 now abandoned.

BACKGROUND OF INVENTION

The present invention relates to the interface between a circuit breaker operating mechanism and a multipole circuit breaker, and, more particularly, to the precision location of a trip actuator unit mounted on the cover unit and a circuit breaker operating mechanism to trip a multipole circuit breaker.

In a circuit breaker of a phase cassette concept, the functional relationship between the operating mechanism and the trip actuator unit is such that when the trip actuator unit indicates a trip signal, the actuator must interface with the mechanism at the trip latch to open the breaker. Tolerances in the system hinder this functional relationship. A precision relation must necessarily be established between the circuit breaker operating mechanism and the trip actuator unit.

In U.S. Pat. No. 5,281,776 entitled "Multipole Circuit Breaker With Single-Pole Units", single-pole units of a general box-like parallelepipedic shape are arranged side-by-side and are linked by alignment rods extending perpendicularly through the opposing side faces of each box. Since the internal components of each single-pole unit are framed laterally with a small clearance by the opposing side faces and are free to move slightly in other directions to compensate for irregularities in manufacturing or positioning, a certain amount of tolerance buildup results. Excessive tolerance buildup may cause the inadequate performance of the circuit breaker.

In U.S. Pat. No. 5,581,219 entitled "Circuit Breaker", the trip actuator unit is in the form of a cassette detachably mounted on a molded base, and the molded base is detachably mounted to a cover of a circuit breaker casing. The cover rests on the casing of the unit, and the trip actuator unit and other accessories are properly located on the breaker by being mounted in recesses formed in the cover.

Because a precision spatial relationship is required between the trip actuator unit and the breaker operating mechanism for the proper functioning of the circuit breaker, tolerances in the system must be minimized. In order to minimize these tolerances, clearances between parts are eliminated by bringing parts into physical contact with each other and by dimensioning the circuit breaker such that critical components have a direct spatial relationship with other critical components.

SUMMARY OF INVENTION

The above discussed and other drawbacks and deficiencies are overcome or alleviated by a precision location system for a circuit breaker utilizing a phase cassette concept. The precision location system is between an actuator accessory and an operating mechanism in the circuit breaker having a cover plate configured to receive the actuator accessory. The cover plate is further configured to receive the operating mechanism and is configured to align the actuator accessory with said operating mechanism when the actuator accessory and operating mechanism are received in said cover plate.

In an exemplary embodiment, the cover plate has a first protrusion depending therefrom, which contains an alignment groove configured to engage an alignment rod extending through a plurality of single-pole breaking units to align the same. The alignment groove may or may not conform to the outer shape of the alignment rod. A second protrusion containing an alignment groove may depend from the cover plate to engage the same alignment rod at a different point, thereby providing additional side-to-side securement of the cover plate on the alignment rod. In an alternate embodiment, the alignment grooves may snappingly engage the alignment rods. A location tab disposed on the actuator provides a means for precisely mounting the actuator on the cover plate, thereby precisely locating the trip actuator unit on the circuit breaker operating mechanism.

Because the operating mechanism and the actuator accessory are mounted on different components within the phase cassette system, a location system is preferably utilized to precisely define the relationships between all of the components involved. The location system thus allows for a closely toleranced relationship between the cassette and the trip actuator unit by utilizing at least one alignment rod extending laterally through breaking units within the phase cassette assembly.

DETAILED DESCRIPTION

Figure 1:
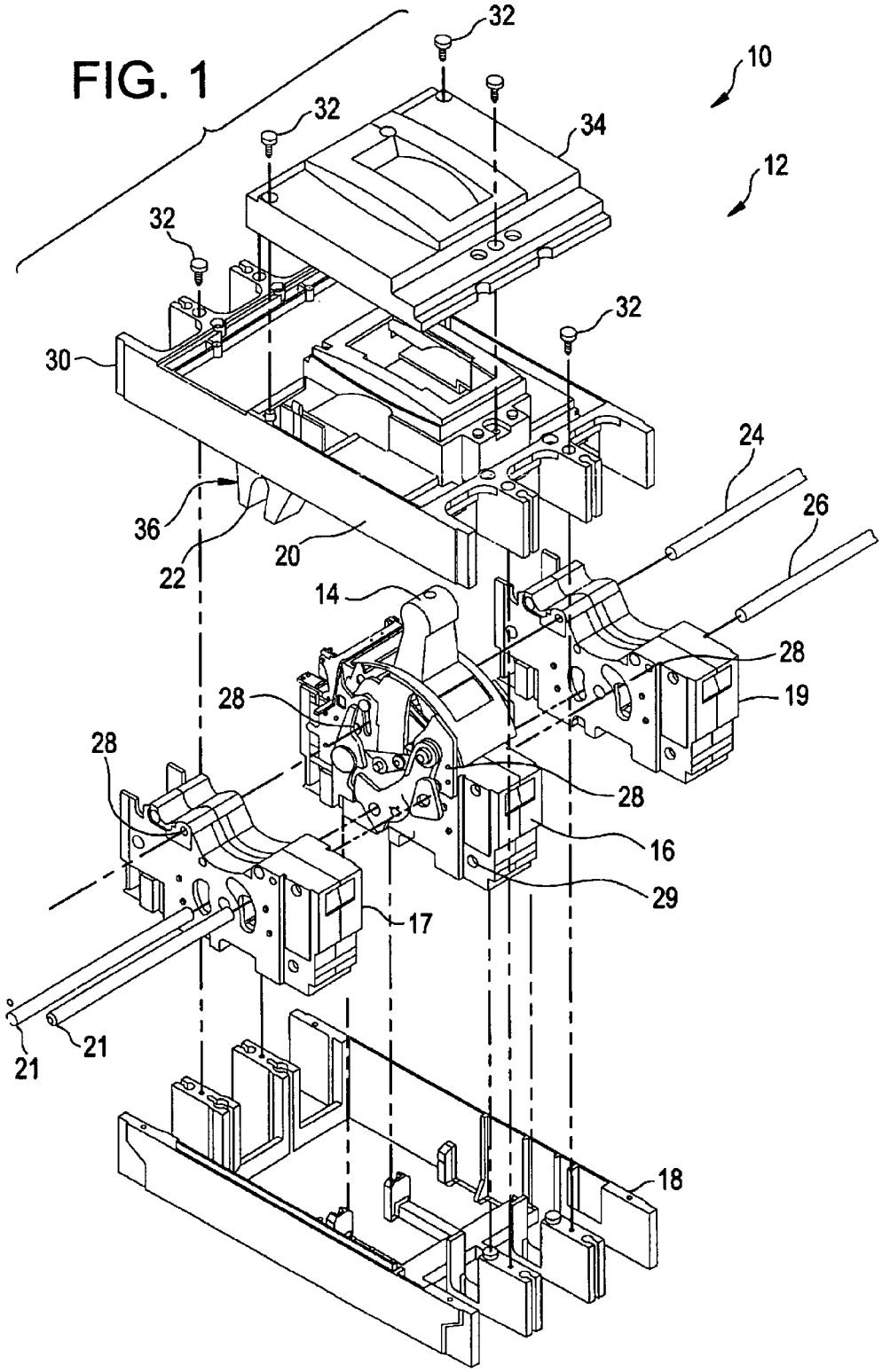
FIG. 1 is an exploded isometric view of the circuit breaker showing the precision location system, of the present invention.

Referring to FIG. 1, a precision location system between an actuator accessory and a breaker operating mechanism is shown generally at 10. Precision location system 10 comprises a phase cassette assembly 12 and an actuator (shown below with reference to FIG. 4) operably connected to a breaker operating mechanism 14. Phase cassette assembly 12 comprises at least one breaker unit 16 housed in a base portion 18 having a mid-cover 20 securable to base portion 18. A protrusion 36 having an alignment groove 22 depends from mid-cover 20 and engages a first alignment rod 24 inserted through breaker unit 16 and any adjacent breaker units 17, 19 and breaker operating mechanism 14. Alignment groove 22 engaging alignment rod 24 precisely locates actuator and breaker operating mechanism 14 to ensure that breaker unit 16 and adjacent breaker units 17, 19 will be tripped when the appropriate signal is received.

To maintain proper alignment between breaker units 16, 17 housed within phase cassette assembly 12, first alignment rod 24 and a second alignment rod 26 are inserted through holes 28 in the sides of breaker units 16, 17, 19. First alignment rod 24 and second alignment rod 26, when inserted laterally through breaker units 16, 17, 19, prevent breaker units 16, 17, 19 from moving laterally relative to each other within phase cassette assembly 12.

Protrusion 36 having alignment groove 22 depends from an edge of an underside 30 of mid-cover 20 and is dimensioned to fit between breaker units 16, 17. In the preferred embodiment, a second protrusion (not shown) depends from an opposing edge of underside 30 to fit between breaker unit 16 and adjacent breaker unit 19. First alignment rod 24 extending laterally through holes 28 in breaker unit 16 and adjacent breaker units 17, 19 is received by alignment groove 22. The point at which first alignment rod 24 extends through breaker unit 16 is dimensioned from the centerline of an axis of a rotary contact arm (not shown) housed inside breaker unit 16, which functions to break the circuit and interrupt the flow of current in the event an overcurrent occurs. In the final assembly, fasteners 32 are used to secure mid-cover 20 to base portion 18 and a top cover 34 to mid cover 20.

Figure 2:
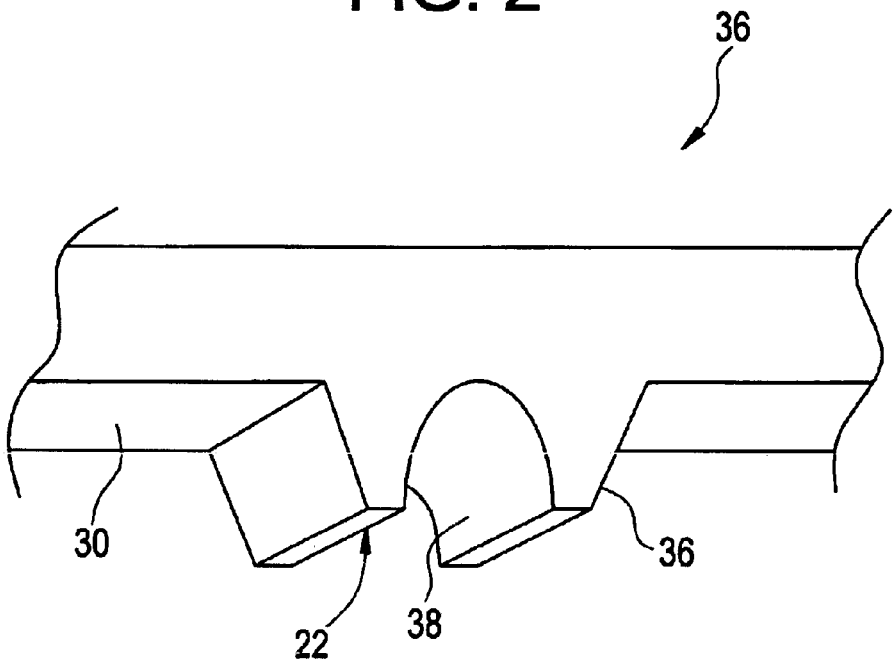
FIG. 2 is an isometric view of an alignment groove, of the present invention.

Referring now to FIG. 2, protrusion is shown generally at 36 and in greater detail. Protrusion 36 depends from underside 30 of mid-cover 20 and includes alignment groove 22. Alignment groove 22 is defined by a surface 38 that conforms to the outer cross sectional surface of first alignment rod 24. As shown, surface 38 is rounded to engage an alignment rod having a circular cross section. When phase cassette 12 is fully assembled, first alignment rod 24 engages surface 38 and precisely locates mid-cover 20 on base portion 18. In a preferred embodiment, protrusion 36 is integrally molded into an underside 30 of mid-cover 20.

Figure 3:
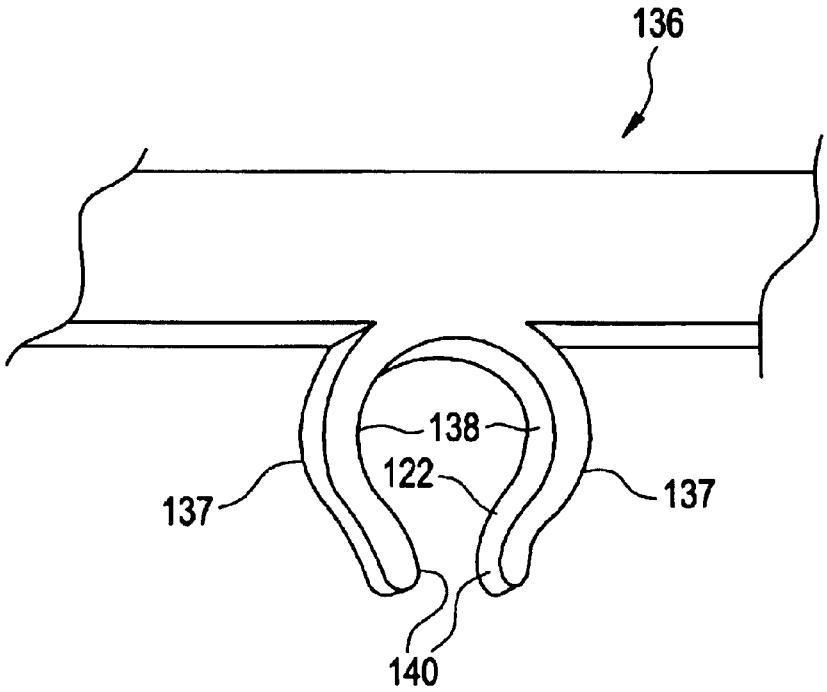
FIG. 3 is an isometric view of an alternate embodiment of an alignment groove, of the present invention.

Alternately, an alignment groove may snappingly receive first alignment rod 24. Referring now to FIG. 3, an alternate embodiment of protrusion is shown generally at 136. In such a case, alignment groove 122 comprises two prongs 137 having inner surfaces 138 substantially conforming to an outer cross sectional surface of first alignment rod 24. Typically, since alignment rod 24 is of a circular cross section, inner surfaces 138 of prongs 137 are arcuate. Prongs 137 are positioned to snappingly receive alignment rod 24 transversely with respect to phase cassette assembly 12.

Each prong 137 protrudes substantially normally away from the general plane of mid-cover 20. A protruding end of each prong 137 contains a generally rounded surface 140, which facilitates the movement of prongs 137 around alignment rod 24 when mid-cover 20 is closed and alignment groove 122 is forced over alignment rod 24. When prongs 137 of alignment groove 122 are forced to engage alignment rod 24, rounded surfaces 140 force prongs 137 to flex away from each other. Once alignment rod 24 is more than half way into alignment groove 122, rounded surfaces 140 close over alignment rod 24 and prongs 137 flex back toward each other to snappingly retain alignment rod 24 between prongs 137.

Figure 4:
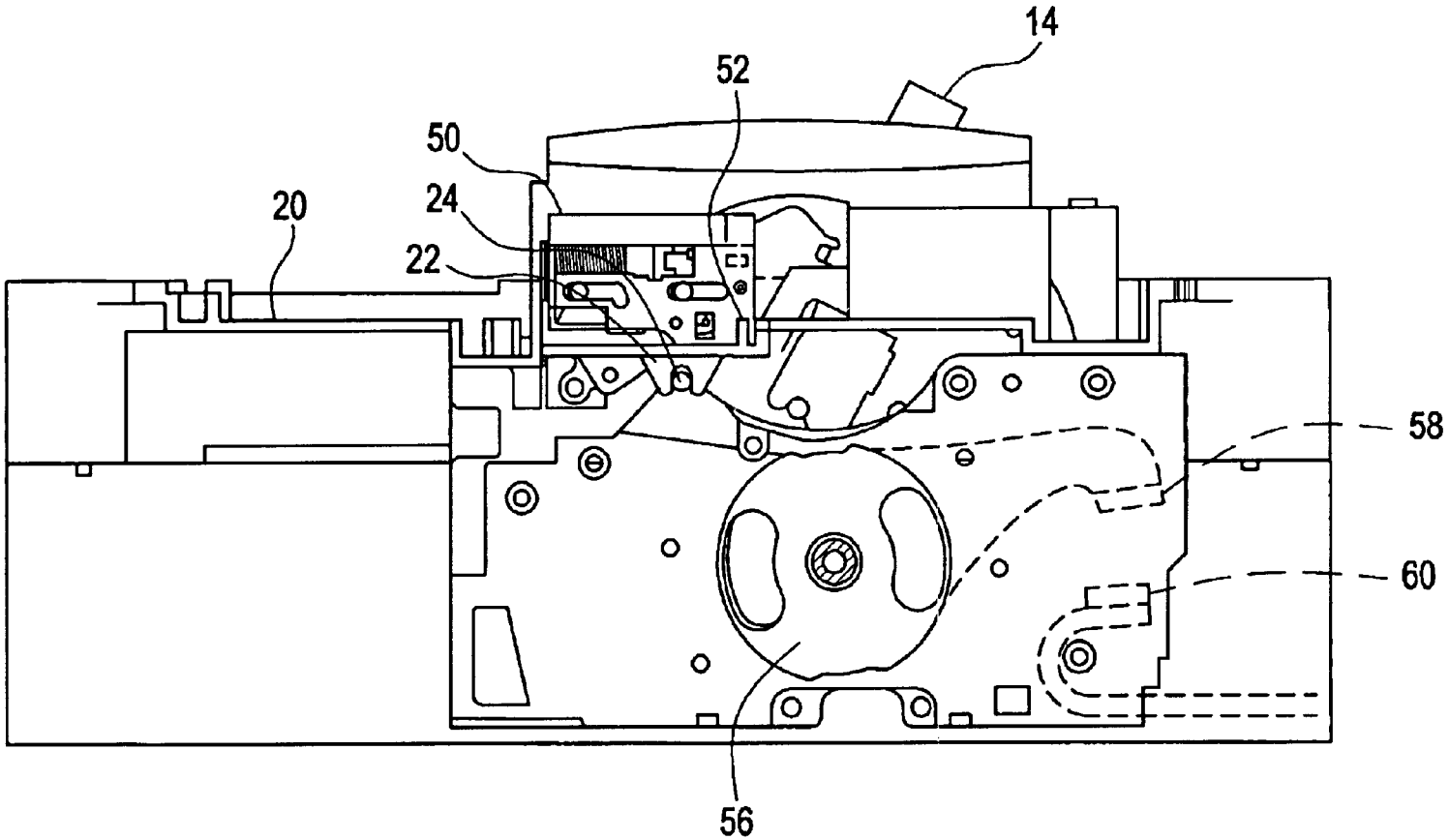
FIG. 4 is a side elevated view of the circuit breaker showing the precision location system, of the present invention, fitted to an alignment rod.

Referring now to FIG. 4, alignment groove 22 is shown fitted over first alignment rod 24 to locate and align mid-cover 20 on phase cassette assembly 12. The position of alignment groove 22 on mid-cover 20 is dimensioned from the center axis of rotary contact arm 56 housed inside breaker unit 16. Rotary contact arm 56 includes a first contact 58 extending therefrom in switchable electrical contact with a second contact 60 (shown in phantom). A precision fit between the engagement surface of alignment groove 22 and first alignment rod 24 minimizes the tolerances between breaker units 16, 17 and breaker operating mechanism 14, thereby avoiding tolerance buildup in precision location system 10.

In precision location system 10, a precision relationship is critical to system performance. Actuator 50 serves to trigger the breaker operating mechanism 14 and trip breaker unit 16, thereby tripping adjacent breaker units 17, 19 and removing power to the circuit. Actuator 50 is mounted on mid-cover 20 and properly aligned thereon by means of an actuator location tab 52. An accurate relationship between actuator location tab 52 and alignment groove 22 on mid-cover 20 is maintained. This, in conjunction with the precision fit between alignment groove 22 and first alignment rod 24, aids in minimizing the tolerance accumulation between actuator 50 and operating mechanism 14. Precision mounting of components ensures the minimization of tolerance accumulation and will ensure that all breaker units are tripped when a signal to do so is received.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A precision location system between an actuator accessory and an operating mechanism in a circuit breaker, said precision location system comprising:

a cover plate configured to receive the actuator accessory, said cover plate further configured to receive the operating mechanism, and said cover plate configured to align the actuator accessory with said operating mechanism when the actuator accessory and operating mechanism are received in said cover plate.

2. The system of claim 1 wherein said cover plate is configured having a defined cavity to locate said operating mechanism therewith, said cover plate is further configured with a location feature to position said actuator accessory thereto and align said actuator accessory with said operating mechanism.

3. The system of claim 2 wherein said location feature includes a location tab extending from said cover plate.

4. The system of claim 2 wherein said cover plate includes an alignment groove configured therein to receive an alignment rod extending through a plurality of cassettes and said operating mechanism, said alignment rod configured to align said plurality of cassettes with each other and with respect to said cover plate.

5. The system of claim 4 wherein said alignment groove is defined by a surface that conforms to an outer surface of said alignment rod.

6. The system of claim 4 wherein said alignment groove is integrally molded into an underside of said cover plate.

7. The system of claim 4 wherein said alignment groove comprises prongs having inner surfaces that substantially conform to an outer surface of said alignment rod.

8. The system of claim 7 wherein said prongs are positioned to snappingly receive said alignment rod.

9. The system of claim 7 wherein said prongs each contain a rounded surface to facilitate movement of said prongs around said alignment rod when said alignment groove engages said alignment rod.

10. A precision location system between an actuator accessory and an operating mechanism in a circuit breaker, the circuit breaker including a plurality of cassettes mounted within a circuit breaker housing, the housing including a cover plate, the precision location system comprising:

an alignment rod extending between the plurality of cassettes and the operating mechanism;

a means for securing the actuator accessory to the cover plate; and a means for securing the cover plate to said alignment rod, said means for securing the cover plate includes means for aligning said actuator assembly with said operating mechanism.

11. The precision location system of claim 10 wherein said means for aligning said actuator accessory comprises an alignment groove disposed on the cover plate, said alignment groove having a surface that matingly corresponds with a surface of said alignment rod.

12. The precision location system of claim 11 wherein said alignment groove comprises prongs, said prongs having surfaces that matingly correspond with said surface of said alignment rod and snappingly engage said alignment rod to secure the cover plate to said alignment rod.

13. A precision location system for a circuit breaker utilizing a phase cassette concept comprising:

a cover configured to align an actuator accessory with an operating mechanism in operable communication with a plurality of single-pole breaking units;

a first alignment feature in operable communication with said cover, said first alignment feature configured to align said plurality of cassettes with each other and with respect to said cover; and a second alignment feature configured to align said actuator accessory with said operating mechanism, said second alignment feature configured in said cover to position said actuator accessory therewith.

14. The system of claim 13, wherein said first alignment feature includes an alignment rod extending through said plurality of single-pole breaking units and said operating mechanism to interconnect and align said plurality of single-pole breaking units, said first alignment feature further includes an alignment groove configured in said cover, said alignment groove configured to receive said alignment rod and align said operating mechanism with said actuator accessory.

15. The system of claim 13, wherein said second alignment feature includes a location tab extending from said cover configured to be received in a complementary configured cavity in said actuator accessory for proper positional alignment therebetween.

16. The system of 13, wherein said operating mechanism is cooperably connected to each rotary phase cassette of said plurality of single-pole breaking units via a connecting rod extending therethrough, said actuator accessory secured to said cover being cooperably connected to said circuit breaker operating mechanism.

17. A circuit breaker having a precision location system between an actuator accessory and an operating mechanism in the circuit breaker, the circuit breaker comprising:

a plurality of single-pole breaking units positioned adjacent each other and in operable communication with the operating mechanism; and a cover plate configured to receive the actuator accessory, said cover plate further configured to receive the operating mechanism, and said cover plate configured to align said actuator accessory with said operating mechanism when said actuator accessory and operating mechanism are received in said cover plate.

18. The circuit breaker of claim 17 wherein each single-pole breaking unit of said plurality of single-pole breaking units positioned adjacent each other comprises:

a box, a first contact housed within said box, and a rotary contact arm pivotally supported within said box by a rotor, said rotary contact arm having a second contact disposed thereon wherein said rotary contact arm is rotatable between a first position wherein said first contact engages said second contact and a second position wherein said first contact is not engaged with said second contact;

at least one alignment rod disposed laterally within said plurality of single-pole breaking units configured to maintain said boxes such that said boxes are rectilinearly oriented relative to each other;

at least one connecting rod extending laterally through said rotors of each single-pole breaking unit in said plurality of single-pole breaking units configured to interconnect said rotors;

a cover plate engageable with said at least one alignment rod;

a circuit breaker operating mechanism cooperably connected to said at least one connecting rod, said circuit breaker operating mechanism moving said rotary contact arm between said first position and said second position; and an actuator secured to said cover plate and being cooperably connected to said circuit breaker operating mechanism for triggering the circuit breaker operating mechanism.

19. The circuit breaker of claim 18 wherein said cover plate has a first protrusion depending therefrom, said first protrusion containing an alignment groove configured to engage said alignment rod.

20. The circuit breaker of claim 19 wherein said alignment groove contains a surface that substantially conforms to an outer shape of said alignment rod.

21. The circuit breaker of claim 19 wherein said cover plate contains a second protrusion depending therefrom at a point distal from said first protrusion and wherein said second protrusion contains an alignment groove configured to engage said alignment rod.

22. The circuit breaker of claim 19 wherein said alignment groove is configured to snappingly engage said alignment rod.

23. The circuit breaker of claim 18 wherein said actuator contains a location tab for precisely mounting said actuator on said cover plate.

* * * * *